United States Patent [19]

Renold

[11] 4,080,162

[45] Mar. 21, 1978

[54] TECHNICAL N-ALKYL-1,3-PROPYLENE DIAMINE AND FORMULATIONS CONTAINING SAME

[75] Inventor: Adolph Renold, Somerset, N.J.

[73] Assignee: Colgate-Palmolive Company, New York, N.Y.

[21] Appl. No.: 741,429

[22] Filed: Nov. 12, 1976

Related U.S. Application Data

[62] Division of Ser. No. 569,162, Apr. 18, 1975, Pat. No. 4,001,123, which is a division of Ser. No. 287,834, Sep. 11, 1972, Pat. No. 3,891,563.

[51] Int. Cl.[2] ..... D06M 13/34

[52] U.S. Cl. ..... 8/115.6; 252/8.8; 260/583 N

[58] Field of Search ..... 8/115.6 A; 252/8.8; 260/583 N

[56] References Cited

U.S. PATENT DOCUMENTS

| | | | |
|---|---|---|---|
| 3,351,483 | 11/1967 | Miner et al. | 252/8.8 X |
| 3,573,091 | 3/1971 | Waldman et al. | 252/8.8 X |

OTHER PUBLICATIONS

Schwartz et al., Surface Act. Agents & Detergents II, Interscience, 1958, pp. 156–157.

*Primary Examiner*—William E. Schulz

*Attorney, Agent, or Firm*—Herbert S. Sylvester; Murray M. Grill; Norman Blumenkopf

[57] ABSTRACT

The odor of technical N-alkyl ($C_{12}$-$C_{22}$)-1,3-propylene diamines may be improved by treating the diamine with maleic anhydride. The addition of small amounts of urea and/or sugar to the treated N-alkyl-1,3-propylene diamine further improves the fabric softening properties of the diamines and reduces fabric discoloration.

10 Claims, No Drawings

TECHNICAL N-ALKYL-1,3-PROPYLENE DIAMINE AND FORMULATIONS CONTAINING SAME

This is a divisional of application Ser. No. 569,162 filed Apr. 18, 1972 and now U.S. Pat. No. 4,001,123, which is in turn a divisional of application Ser. No. 287,834 filed Sept. 11, 1972 and now U.S. Pat. No. 3,891,563.

BACKGROUND OF THE INVENTION

This invention relates to methods for improving the odor, color and fabric softening properties of N-higher alkyl-1,3-propylene diamines and of fabric softening compositions incorporating the improved N-higher alkyl propylene diamines.

The use of synthetic detergent compositions in heavy-duty household laundering has become a widespread practice. The formulations conventionally employed generally comprise synthetic detergent surfactants and alkaline builder salts which function to enhance the cleaning levels of synthetic materials. Some inorganic builder materials present in detergent formulations have been known to have a tendency to react with the metal ions present in the washing solution, precipitating out insoluble salts which deposit on the textile material being laundered. Such deposited mineral salts give the laundered fabrics a poor boardy feel, particularly at those areas of the fabric which are exposed to frictional and creasing effects such as collars and cuffs. This poor hand of laundered fabrics and resulting discomfort during use have in part resulted in the creation of a large and expanding market for softener formulations capable of improving the softeness or "hand" of laundered textiles. It has been found that the treatment of such materials with softening agents improves their softness of feel and may prolong the useful life of the textile materials. In addition, it has been found that such treatment generally results in a fabric having a reduced tendency to accumulate electrical charges, which fact facilitates the ironing of treated materials.

N-higher alkyl-1,3-propylene diamines are valuable softening agents and are compatible with most synthetic detergent formulations. However, heretofore they have not won much acceptance for use as fabric softeners, because the generally available technical grade N-higher alkyl-1,3-propylene diamines are characterized by an unpleasant odor which cannot be masked by the detergent perfumes currently available.

Additionally, the technical grade N-higher alkyl-1,3-propylene diamines have a tendency to discolor synthetic fabrics such as polyamides, polyesters, and the like regular household laundry; this discoloration darkens upon aging. The best explanation for the discoloration is that it is a heavy metal (e.g., iron) catalyzed decomposition of the diamine, which is a known heavy metal scavenger and used as such in the oil industry.

Presently, one of the best known methods for improving the properties of technical grade N-higher alkyl propylene diamines is by vacuum distillation. However, this method is expensive and relatively ineffective; the resulting diamine is not improved significantly, and it is prohibitively expensive for use in detergent formulations. In tergitometer tests using a commercially available household laundry detergent, no significant difference between the crude and distilled diamine was found. Nylon cleaning was particularly poor.

SUMMARY OF THE INVENTION

It has now been discovered that the properties of technical grade N-higher alkyl-1,3-propylene diamines, where the alkyl group contains from 12 to 22 carbon atoms, may be significantly improved by treatment with maleic anhydride. Additionally, it has been found that the addition of small amounts of urea and/or sugar to the treated N-higher alkyl-1,3-propylene diamines improves the fabric softening ability of the diamines.

The commercial diamines have an unattractive color and a malodor characteristic of amines. This color and amine malodor can be reduced, however, by treating the diamine with maleic anhydride. The addition of a maleic anhydride solution to the diamine initially causes the mixture to turn thin and yellow. After a short period of time, the yellow color and a significant part of the odor disappear.

The ratio of N-higher alkyl-1,3-propylene diamine to maleic anhydride ranges from 25:1 to 5:1 by weight. A preferred solvent for the maleic anhydride is methylethylketone.

The addition of urea or sugar or mixtures of urea and sugar to the treated N-alkyl-, 3-propylene diamines greatly and unexpectedly improves the softening properties of the diamines. The urea and/or sugar is present in amounts ranging from about 1% to about 200% by weight of the treated diamine.

The N-higher alkyl-1,3-propylene diamines treated according to the present invention are valuable softening agents for textiles and fabrics manufactured from synthetic and natural fibers and blends thereof, inclusive of cellulose, Dacron-cotton blends, nylon, wool, cotton, orlon, orlon blends and the like. The treated diamines may be used as a rinse additive or in conjunction with a suitable laundry detergent in the wash cycle. Where urea and/or sugar are added to the diamine, the resulting mixture can be used in the same manner.

Where the treated N-higher alkyl-1,3-propylene diamines of the present invention are to be used as rinse additives, they may be mixed with compatible solid additives and fillers, e.g., aluminum silicate, sodium tripolyphosphate, sodium carbonate, sodium sulfate, and the like. The concentration of the N-higher alkyl-1,3-propylene diamine in these compositions can range from about 5 to about 50%, although a range of between 15 and 30% is preferred.

Additionally, the treated N-higher alkyl-1,3-propylene diamines may be dispersed or dissolved in suitable liquid systems where a liquid rinse additive is desired. Examples of such liquids include propylene glycol, ethylene glycol, and isopropanol; the diamine may then be present in amounts ranging from 10 to 95% of the weight of the final formulation, although a range of from about 30 to about 60% is preferred.

The N-higher alkyl-1,3-propylene diamines treated according to the present invention are particularly well suited for incorporation in detergent formulations. Such softener-detergent compositions are commonly referred to as "softergents." In such softergent compositions the treated diamine comprises from about 1 to about 90% by weight of the total composition, and preferably about 5 to 50% by weight of the total composition.

The softergents containing the treated diamines of this invention can contain any of the usual compatible adjuvants, diluents, and additives including for example, anionic, nonionic, amphoteric, or detergents, perfumes, antiredeposition agents, bacteriostatic agents, dyes, fluorescent dyes, brighteners, suds builders, suds depressors, and the like without detracting from the advantageous properties of the composition.

The treated N-higher alkyl-1,3-propylene diamines of the present invention impart the desired degree of softness to textiles treated therewith when utilized in amounts of from about 0.05 to about 5 percent, and preferably, in amounts ranging from 1 to 3 percent by weight of the fabric.

Suitable anionic surface active agents include those surface active or detergent compounds which contain an organic hydrophobic group and an anionic solubilizing group. Typical examples of anionic solubilizing groups are sulfonate, sulfate, carboxylate, phosphonate and phosphate. Examples of additional suitable anionic detergents which fall within the scope of the invention include the soaps, such as the water-soluble salts of higher fatty acids or rosin acids, such as may be derived from fats, oils and waxes of animal, vegetable or marine origin, e.g., the sodium soaps of tallow, grease, coconut oil, tall oil and mixtures thereof; and the sulfated and sulfonated synthetic detergents, particularly those having about eight to 26, and preferably about 12–22, carbon to the molecule.

As examples of suitable synthetic anionic detergents there may be cited, e.g., the sodium salts of higher alkyl mononuclear aromatic sulfonates such as the higher alkyl benzene sulfonates containing from 10 to 16 carbon atoms in the alkyl group in a straight or branched chain, higher alkyl toluene, xylene and phenol sulfonates; alkyl naphthalene sulfonate, ammonium diamyl naphthalene sulfonate, and sodium dinonyl naphthalene sulfonate.

Other anionic detergents are the olefin sulfonates, including long-chain alkene sulfonates, long-chain hydroxy-alkane sulfonates or mixtures of alkenesulfonates and hydroxyalkanesulfonates. The olefin sulfonate detergents may be prepared, in known manner, by the reaction of $SO_3$ with long chain olefins (of 8–25, preferably 12–21 carbon atoms) of the formula R'CH=CHR", where R' is alkyl and R" is alkyl or hydrogen, to produce a mixture of sultones and alkenesulfonic acids, which mixture is then treated to convert the sultones to sulfonates. Examples of other sulfate or sulfonate detergents are paraffin sulfonates, such as the reaction products of alpha olefins and bisulfites (e.g., sodium bisulfite), e.g., primary paraffin sulfonates of about 10–20, preferably about 15–20, carbon atoms; sulfates or higher alcohols; salts of $\alpha$-sulfofatty esters (e.g., of about 10–20 carbon atoms, such as methyl $\alpha$-sulfomyristate or $\alpha$-sulfotallowate).

Examples of sulfates of higher alcohols are sodium lauryl sulfate, sodium tallow alcohol sulfate, Turkey Red Oil or other sulfated oils, or sulfates of mono-or di-glycerides of fatty acids (e.g., stearic monoglyceride monosulfate), alkyl poly (ethenoxy) ether sulfates such as the sulfates of the condensation products of ethylene oxide and lauryl alcohol (usually having one to five ethenoxy groups per molecule); lauryl or other higher alkyl glyceryl ether sulfonates; aromatic poly(ethenoxy) ether sulfates such as the sulfates of the condensation products of ethylene oxide and nonyl phenol (usually having one to six oxyethylene groups per molecule).

Nonionic surface active agents include those surface active or detergent compounds which contain an organic hydrophobic group and a hydrophilic group which is a reaction product of solubilizing group such as carboxylate or hydroxyl, with ethylene oxide.

As examples of nonionic surface active agents which may be used there may be noted the condensation products of alkyl phenols with ethylene oxide, e.g., the reaction product of isooctyl phenol with about six to 30 ethylene oxide units; condensation products of alkyl thiophenols with 10 to 15 ethylene oxide units; condensation products of higher fatty alcohols such as tridecyl alcohol with ethylene oxide; ethylene oxide addends of monoesters of hexahydric alcohols and inner ethers thereof such as sorbitan monolaurate, sorbitol monooleate and mannital monopalmitate, and the condensation products of polypropylene glycol with ethylene oxide. Other nonionics include amine oxides, e.g., lauryl dimethyl amine oxide; sulfoxides and the like.

In addition to the treated N-higher alkyl-1,3-propylene diamines and active detergent, softergents prepared according to the present invention may contain one or more water-soluble detergency builder salts either of the organic or the inorganic type and preferably alkaline salts.

Examples of water-soluble inorganic detergency builder salts are alkali metal carbonates, phosphates, polyphosphates, sulfates, silicates, etc. Specific examples of such salts are sodium, potassium, and lithium tripolyphosphates, carbonates, pyrophosphate, orthophosphates, and hexametaphosphates, sodium, potassium, and lithium sulfates; and sodium, potassium, and lithium silicates. Examples of organic alkaline detergency builder salts are (1) alkali metal aminopolycarboxylates [e.g., sodium and potassium ethylenediaminetetraacetates, N-(2-hydroxyethyl)-nitrilo diacetates]; (2) alkali metal salts of phytic acid (e.g., sodium and potassium phytates — see U.S. Pat. No. 2,739,942); (3) water-soluble salts of ethane-1-hydroxy-1,1-diphosphonate (e.g., the trisodium and tripotassium salts — see U.S. Pat. No. 3,159,581); (4) water-soluble salts of methylene diphosphonic acid (e.g., trisodium and tripotassium methylene diphosphonate and the other salts described in U.S. Pat. No. 2,213,030); (5) water-soluble salts of substituted methylene diphosphonic acids (e.g., trisodium and tripotassium ethylidene, isopropylidene, benzylmethylidene, and halomethylidene diphosphonates); (6) water-soluble salts of polycarboxylate polymers and copolymers (e.g., homopolymers of itaconic acid, aconitic acid, maleic acid, mesaconic acid, fumaric acid, methylene malonic acid, and copolymers thereof with other compatible copolymerizable monomers such as ethylene); and mixtures thereof.

The softergents of the present invention may be formulated as liquids, solids, pastes, gels, etc. The softergents of the present invention can be effectively used for laundering fabrics in water having a temperature from about 60° to about 212° F., the softergents containing the treated N-higher alkyl-1,3-propylene diamines exhibiting unusually effective detergency and fabric softening characteristics in both cold and hot water. The softergent composition concentration in the wash water should range from about 0.05 percent to about 0.5 percent by total weight.

In washing fabrics, the addition of the fabrics and the softergent composition can be conducted in any suitable conventional manner. Thus, for example, the fabrics can be added to the container or washer either before or after the washing solution is added. The fabrics are then agitated in the detergent solution for varied periods of time, a wash cycle of from 5 to 15 minutes being generally used in the washing cycle of an automatic agitator type washer. After the fabrics are rinsed, they are dried, first by spinning and then on a clothesline or in an automatic dryer.

In the preparation of the softergent compositions of the present invention, generally, the organic detergent and the treated N-higher alkyl-1,3-propylene diamine, and urea and/or sugar if it is used, as well as the builders and any minor ingredients are incorporated into the composition prior to its conversion into the final form, e.g., detergent granules, flakes, bar, etc. However, the individual components of the softergent of the present invention can be added in the form of particles or directly as a liquid to produce a liquid detergent composition.

DESCRIPTION OF THE PREFFERRED EMBODIMENTS

The following specific examples illustrate various embodiments of the present invention. It is to be understood, however, that such examples are presented for purposes of illustration only, and the present invention is in no way to be deemed as limited thereby.

EXAMPLE I

Two thousand grams of N-tallow-1-3-propylene diamine was placed into a 4-liter glass resin kettle equipped with an Eppenbach stirrer, a heating mantle and a Thermowatch-a heat regulator to keep the temperature of the mixture below 60° C. The following were added in the order listed over a 10 hour period:

| | |
|---|---|
| Maleic anhydride-20 mesh | 64.2 grams |
| Potassium hydroxide solution (47% KOH) | 25.6 grams |
| Ultramarine blue | 5.8 grams |
| Polar brilliant blue | 0.8 grams |
| Stabilizer Givaudan 9-A | 2.0 grams |

The resulting fabric softener was dissolved in isopropanol for convenient addition to detergent wash water.

EXAMPLE II

A fabric softener was prepared according to Example I using the following ingredients in the order listed.

| | Percent by Weight |
|---|---|
| N-tallow 1,3 propylene diamine | 82.88% |
| Maleic anhydride-20 mesh | 2.80% |
| Potassium hydroxide solution (47% KOH) | 1.12% |
| Ultramarine blue | 0.25% |
| Polar brilliant blue | 0.04% |
| Stabilizer Givaudan 9-A | 0.09% |
| Urea | 2.48% |
| Sugar | 2.09% |
| Ethylene glycol | 8.25% |

EXAMPLE III

A fabric softener was prepared according to Example I using the following ingredients in the order listed:

| | Percent by Weight |
|---|---|
| N-tallow propylene diamine | 68.74% |
| Maleic anhydride-20 mesh | 2.32% |
| Potassium hydroxide solution (47% KOH) | 0.93% |
| Ultramarine blue | 0.21% |
| Polar brilliant blue | 0.03% |
| Stabilizer Givaudan 9-A | 0.07% |
| Urea | 2.06% |
| Sugar | 1.73% |

-continued

| | Percent by Weight |
|---|---|
| Ethylene glycol | 23.91% |

In order to test the effectiveness of the softeners of the preceding examples, the Mini-Wash Test was developed. A cotton terry towel weighing 115 grams was washed in a General Electric household washing machine in tap water (100 p.p.m. hardness) at 120° F. One hundred grams of detergent (10% anionic, 2% nonionic, 1% soap, 33% sodium tripolyphosphate) were dissolved in the wash water, as well as the amounts shown in the following table of the softeners of the preceding examples dissolved in 30ml. isopropanol. The towel was air dried overnight and organolepitically evaluated. The softness ratings of the towels washed in the test are shown in the following table.

Results of MINI-WASH TEST

| Softener | Softness Rating |
|---|---|
| Detergent only - control | 1 = no softening |
| 5.0g. Softener of Example I | 8 = good softening |
| 5.75G. Softener of Example II | 10 = excellent softening |
| 5.0g. Softener of Example II | 8 = good softening |
| 4.3g. Softener of Example I | 5 = perceptible softening |

This experiment illustrates the synergism existing between the urea and the treated N-tallow 1,3 propylene diamine. Five grams of treated diamine is present in 5.75 grams of the treated diamine-urea-sugar mixture of Example II, therefore, the mixture gave better softening than 5.0g. diamine alone. Five grams of the mixture of Example II contains 4.3 grams of treated diamine, and again outperformed 4.3 grams of diamine alone in softening ability.

It is essential that the softener be dispersed during washing. The high melting point and water insolubility of the diamines which cause loss of softening and spotting of the treated fabrics have been alleviated by dissolving the treated diamine in water soluble diamine solvents such as isopropanol and ethylene glycol. The use of low volatility solvents helps spray drying and reduces fire hazard during manufacture.

EXAMPLE IV

A fabric softening composition to be added in the final rinse of the wash cycle was formulated as follows:

| | |
|---|---|
| Softener of Example I | 30 grams |
| Urea | 6 grams |
| Sodium tripolyphosphate | 54 grams |
| Zeolex 23A* | 30 grams |
| Synthetic detergent (18% anionic/7% sodium silicate/ 33% sodium phosphate/0.4% carboxymethylcellulose) | 30 grams |

*Heat-treated, naturally occurring aluminum silicate anticaking agent.

EXAMPLE V

The treated diamines can be formulated with urea as dry powders to be added simultaneously with detergent to the wash water or by themselves to the rinse water. A typical formulation is as follows:

| | |
|---|---|
| Diamine treated according to Example I | 23 grams |

-continued

| | |
|---|---|
| Sodium carbonate | 23 grams |
| Urea | 12 grams |
| Zeolex 23A* | 20 grams |
| Carboxymethylcellulose | 4 grams |
| Optical brighteners | 0.4 grams |
| Lemon Tang perfume | 0.4 grams |

*Heat-treated, naturally occurring aluminum silicate anti-caking agent.

The above mixture was heated in a mortar to a temperature of between 48° and 52° C., powdered, and cooled to room temperature. The mixture was then passed through an 8 mesh sieve and ball milled for two hours. The resulting product was free-flowing with no dusting, and was sufficiently soluble even in relatively cool water to be an effective fabric softener.

A white terrycloth towel weighing 115 grams was washed according to the Mini-Wash Test using 100 grams of 10% anionic/2% nonionic/1% soap/33% sodium tripolyphosphate synthetic detergent, and then rinsed with 20 grams of the fabric softener prepared as above. After air drying, the towel was given a softness rating of 10, signifying excellent softness. The color of the towel was excellent, as the treated diamine fabric softener did not deposit any color onto the white towel.

In a second test, called a Full Load Test, a white terrycloth towel weighing 115 grams was added to 8 pounds of different fabrics. The mixture was washed for 9 minutes in a household washing machine in tap water of 100 p.p.m. hardness at 120° F., with 100 grams of 10% anionic/2% nonionic/1% soap/35% sodium tripolyphosphate synthetic detergent, and then rinsed with 20 grams of the fabric softener/urea formulation described above. After the towel was air dried, it was given a softness rating of 10, indicating excellent softness. The towel showed excellent color.

EXAMPLE VI

A softergent composition was prepared from the following ingredients:

| | |
|---|---|
| Softener of Example V | 164 grams |
| Synthetic detergent (10% anionic/2% nonionic/1% soap/33% sodium tripolyphosphate) | 638 grams |
| Optical brighteners | 7.2 grams |
| Lemon Tang perfume | 1.2 ml. |

A white terrycloth towel weighing 115 grams was washed according to the Mini-Wash test using 120 grams of the softergent above in tap water of 100 p.p.m. hardness at 120° F. After air drying, the towel was given a softness rating of 10, signifying excellent softness. The color of the towel was excellent, as the treated diamine fabric softener did not deposit any color onto the white towel.

In the Full Load Test, a white terrycloth towel weighing 115 grams was added to 8 pounds of assorted fabrics. The mixture was washed for 9 minutes in a household washing machine in tap water of 100 p.p.m. hardness at 120° F. with 120 grams of the softergent as prepared above. After the towel was air dried, it was given a softness rating of 10, indicating excellent softness.

EXAMPLE VII

A liquid fabric softener composition was formulated as follows:

| | Percent by Weight |
|---|---|
| Treated diamine of Example I | 65.0% |
| Ethylene glycol | 28.5% |
| Urea | 3.5% |
| Sugar | 3.0% |

EXAMPLE VIII

A fabric softener/detergent composition was prepared from the following ingredients:

| | |
|---|---|
| Treated diamine of Example I | 34 grams |
| Sodium tripolyphosphate | 14 grams |
| Sodium carbonate | 23 grams |
| Urea | 12 grams |
| Zeolox 23A | 20 grams |
| Carboxymethylcellulose | 4 grams |
| Synthetic detergent (10% anionic/2% nonionic/1% soap/33% sodium tripolyphosphate) | 46 grams |

The mixture was placed in a 110° C. oven and warmed to between 50° and 55° C. The mixture was stirred lightly and cooled to room temperature by placing the mixture into the freezing compartment of a refrigerator for 45 minutes. The mixture was then passed through a 12 mesh screen. The composition was uniform in appearance and remained free-flowing after 2 hours of ball milling.

EXAMPLE IX

A softergent was formulated based on the softener/detergent composition described above as follows:

| | |
|---|---|
| Softener/detergent | 87 grams |
| Synthetic detergent (10% anionic/2% nonionic/1% soap/33% sodium tripolyphosphate) | 313 grams |
| Lemon Tang Perfume | 2 ml. |
| Optical brighteners | 8.0 grams |

A white terrycloth towel weighing 115 grams was washed according to the Mini-Wash Test using 125 grams of the above-described softergent. The towel was air dried and given a softness rating of 9. The color of the towel was excellent.

A white terrycloth towel weighing 115 grams was washed according to the Full Load Test with 125 grams of the above-described softergent. The towel was air dried and given a softness rating of 9, signifying very good softness. The color of the towel was excellent.

EXAMPLE X

A fabric softener/detergent base composition was prepared from the following ingredients:

| | |
|---|---|
| Treated diamine of Example I | 34 grams |
| Sodium carbonate | 23 grams |
| Urea | 12 grams |
| Zeolex 23A | 23 grams |
| Carboxymethylcellulose | 4 grams |
| Highfoam synthetic detergent (25 linear dodecyl benzene sulfonate/25 sodium silicate/4 ethoxylated $C_{12}$-$C_{14}$ alcohol/2 carboxymethylcellulose/1 soap) | 46 grams |

The above ingredients were mixed and placed into a 110° C. oven until the mixture had warmed to between 50° and 55° C. The mixture was stirred lightly and cooled by placing the mixture into the freezing compartment of a refrigerator for 45 minutes. The cooled mixture was then passed through a 12 mesh screen. The product was ball milled for 2 hours, after which time the composition was free-flowing.

The composition thus prepared was used to formulate a high-foaming, phosphate-free softergent by adding to 87 grams of the composition, 313 grams of the high-foam synthetic detergent described above and 1 gram of a stilbene-based optical brightener.

A white terrycloth weighing 115 grams was washed in the Mini-Wash Test using 125 grams of the high-foaming, phosphate-free softergent as prepared above. The towel was air dried and given a softness rating of 4, indicating that there was perceptible softening over a towel washed without softener in the detergent formulation. The color of the towel was excellent.

A white terrycloth towel weighing 115 grams was washed according to the Full Load test with 125 grams of the above-described softergent. The towel was air dried and given a softness rating of 3, signifying that there was perceptible softening over a towel washed without softener in the detergent formulation. The color of the towel was excellent.

It was expected that the softness ratings of the towels would be lower where the softergent was based on a high-foaming detergent, because there is a greater tendency for the high-foaming detergent to remove the softener from the surface of the fabric.

EXAMPLE XI

A fabric softener/detergent composition was prepared from the following ingredients:

| | |
|---|---|
| Treated diamine of Example I | 34 grams |
| Sodium carbonate | 23 grams |
| Zeolex 23A | 23 grams |
| Carboxymethylcellulose | 4 grams |
| Urea | 12 grams |
| Low-foaming detergent (25 linear dodecyl benzene sulfonate/25 sodium silicate/4 ethoxylated $C_{14}$–$C_{15}$ alcohol/ 2 carboxymethylcellulose/6 soap) | 46 grams |

The above ingredients were mixed and placed into a 110° C. oven until the mixture had warmed to between about 50° and 55° C. The mixture was stirred lightly and cooled by placing the mixture into the freezing compartment of a refrigerator for 45 minutes. The cooled mixture was then passed through a 12 mesh screen. The product was ball milled for 2 hours.

The composition thus prepared was used to formulate a low-foaming, phosphate-free softergent by adding to 87 grams of the base composition 313 grams of the low-foaming synthetic detergent described above and 1 gram of a stilbene-based optical brightener.

A white terrycloth towel weighing 115 grams was washed according to the Mini-Wash Test using 125 grams of the low-foaming, phosphate-free softergent as prepared above. The towel was air dried and given a softness rating of 9, meaning good softening. The color of the towel was very good.

A white terrycloth towel weighing 115 grams was washed according to the Full Load test with 125 grams of the low-foaming, phosphate-free softergent as prepared above. The towel was air dried and given a softness rating of 7, which is satisfactory softening. The color of the towel was very good.

EXAMPLE XII

A non-phosphate rinse additive was prepared by grinding the fabric softener/detergent composition of Example X until it passed a 20 mesh screen.

A white terrycloth towel was washed according to the Mini-Wash Test using 100 grams of synthetic detergent, and rinsed with 20 grams of the above-described rinse additive. The rinse additive was completely dissolved in the rinse water within 2 minutes. After the towel was air dried, it was given a softness rating of 9, very good softness. The color of the towel was very good.

The N-higher alkyl propylene diamines treated according to the present invention can be used to treat a variety of fabrics, which can be made from natural animal and vegetable fibers and blends of natural and synthetic fibers as well as entirely from synthetic fibers. These include wool, silk, cotton, linen, glass, acetate, rayon, nylon, dacron, orlon, blends or dacron, e.g., with cotton, Orlon-wool blends, and the like.

Treatment with the N-higher alkyl propylene diamines treated according to the present invention is especially advantageous where it is desired to overcome harshness of feel or to enhance softness to touch and decrease fabric yellowing. Advantages realized herewith are softer, fluffier towels, smoother, silkier sheets and pillowcases, longer garment life, and a whiter and/or brighter fabric.

Although the present invention has been described with reference to particular embodiments and examples, it will be apparent to those skilled in the art that variations and modifications of this invention can be made and that equivalents can be substituted therefore without departing from the principles and true spirit of the invention.

What is claimed is:

1. A method for improving color and odor of N-higher alkyl-1,3-propylene diamines, said higher alkyl group having from 12 to 22 carbon atoms, comprising contacting said N-higher alkyl-1,3-propylene diamines with maleic anhydride.

2. The method of claim 1 wherein said maleic anhydride is dissolved in an organic solvent.

3. The method of claim 1 wherein the ratio of said N-higher alkyl-1,3-propylene diamine to said maleic anhydride ranges from about 25:1 to about 5:1 by weight.

4. The method of claim 1 wherein said N-higher alkyl-1,3-propylene diamine is N-tallow-1,3-propylene diamine or N-hydrogenated tallow-1,3-propylene diamine.

5. A method of softening textiles comprising contacting textile materials in the aqueous rinse cycle of a laundering operation with from about 0.05 percent to about 5 percent by weight of said materials of an N-higher alkyl-1,3-propylene diamine treated according to the method of claim 1, said higher alkyl group having from 12 to 22 carbon atoms.

6. The method of claim 5 wherein said N-higher alkyl-1,3-propylene diamine is N-tallow-1,3-propylene diamine, or N-hydrogenated tallow-1,3-propylene diamine.

7. A method of softening textiles comprising contacting textile materials in the aqueous rinse cycle of a laundering operation with a fabric softener comprising from about 0.05 percent to about 5 percent by weight of said materials of an N-higher alkyl-1,3-propylene diamine treated according to the method of claim 1, said higher alkyl group having from 12 to 22 carbon atoms, and an additive selected from the group consisting of urea, sugar, and mixtures thereof.

8. The method of claim 7 wherein said additive is present in amounts ranging from about 1 to about 200% by weight of said treated N-higher alkyl-1,3-propylene diamine.

9. The method of claim 7 wherein said additive is urea.

10. N-$C_{12-22}$ alkyl-1,3-propylene diamines treated by the method of claim 1.

* * * * *